United States Patent [19]

Lukich

[11] Patent Number: 4,773,243

[45] Date of Patent: Sep. 27, 1988

[54] LOCK PROTECTION MECHANISM

[76] Inventor: Aleksandar Lukich, 1229 12th St., Apt. 6, Santa Monica, Calif. 90401

[21] Appl. No.: 11,784

[22] Filed: Feb. 6, 1987

[51] Int. Cl.[4] ..... E05B 17/14

[52] U.S. Cl. ..... 70/425; 70/455

[58] Field of Search ..... 70/425, 312, 423, 426, 70/455

[56] References Cited

U.S. PATENT DOCUMENTS 4,327,566 5/1982 Ling ..... 70/312

FOREIGN PATENT DOCUMENTS 23372 6/1921 France ..... 70/425

400124 11/1942 Italy ..... 70/425

*Primary Examiner*—Robert L. Wolfe

*Attorney, Agent, or Firm*—Spensley Horn Jubas & Lubitz

[57] ABSTRACT

A ganged co-axial tumbler lock mechanism is provided to lock a slideable shaft coupled to a keyhole cover. Setting the proper combination on the tumbler lock mechanism permits the shaft to be slid away from the cylinder lock, thus moving the keyhole cover away from the cylinder lock keyhole. Once the tumbler lock is opened, a user may set the tumbler lock mechansim to a different combination. The entire mechanism may be constructed as an add-on mechanism for use with existing keyed cylinder locks. In an alternative embodiment, the present invention is integrally formed with a keyed cylinder lock for installation as an original lock.

8 Claims, 2 Drawing Sheets

LOCK PROTECTION MECHANISM

BACKGROUND OF THE INVENTION

1. Field of the Invention

This invention relates generally to locks, and more particularly to a secondary lock adapted to cover the keyhole of a keyed cylinder primary lock.

2. Description of the Prior Art

One drawback of present day keyed cylinder locks is that the keyhole portion of the cylinder is exposed and thus accessible to tampering or picking. The prior art has suggested several means for protecting the keyhole of a lock cylinder by means of a locking keyhole cover, as shown, for example, in U.S. Pat. No. 3,732,711 to Albert and U.S. Pat. No. 4,365,491 to Rubenstein, et al. However, these mechanisms are somewhat complex to manufacture. Therefore, it is an object of this invention to provide an improved lock mechanism for protecting the keyhole of a keyed cylinder lock, and which is simple to manufacture.

It is another object of this invention to provide a simplified and improved lock mechanism for protecting the keyhole of an integral keyed cylinder lock.

SUMMARY OF THE INVENTION

In one embodiment of the invention, a ganged coaxial tumbler lock mechanism is provided to lock a slideable shaft coupled to a keyhole cover. Setting the proper combination on the tumbler lock mechanism permits the shaft to be slid away from the cylinder lock, thus moving the keyhole cover away from the cylinder lock keyhole. Once the tumbler lock is opened, a user may set the tumbler lock mechanism to a different combination.

The entire mechanism may be constructed as an addon mechanism for use with existing keyed cylinder locks. In an alternative embodiment, the present invention is integrally formed with a keyed cylinder lock for installation as an original lock.

The invention will become better understood by reference to the following detailed description when taken in conjunction with the accompanying drawings showing the preferred embodiments of the invention.

DESCRIPTION OF THE DRAWINGS

Like reference numbers in the various figures refer to like elements.

DETAILED DESCRIPTION OF THE INVENTION

Figure 1:
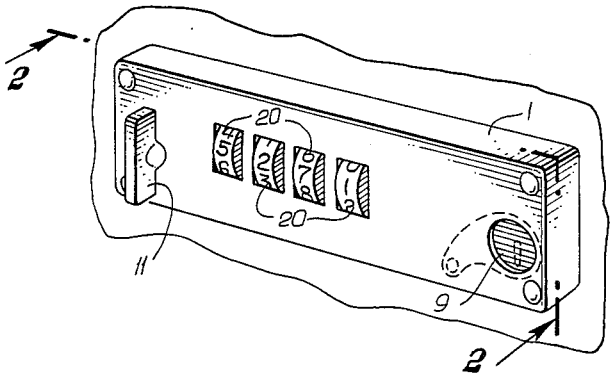
FIG. 1 is a perspective view of a first embodiment of the lock protection mechanism of the present invention showing in phantom outline the keyhole cover plate.

FIG. 1 shows the basic outer appearance of one embodiment of the present invention.

Figure 2:
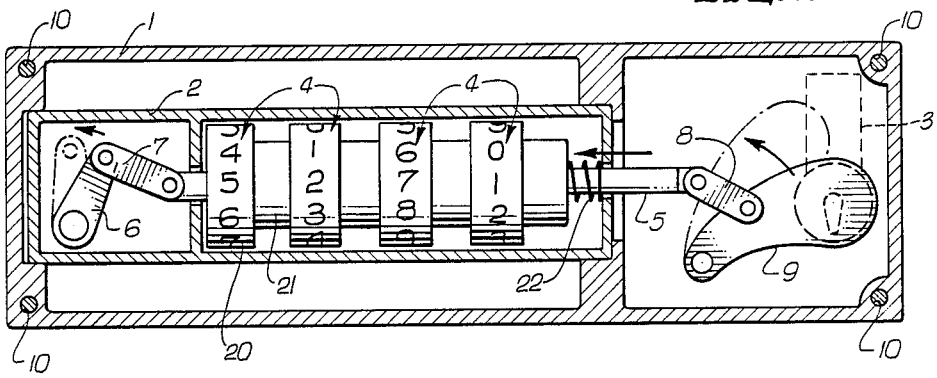
FIG. 2 is an exposed top view of the lock protection mechanism of FIG. 1 having an integral keyed cylinder lock.

FIG. 2 shows an exposed top view of a first embodiment of the present invention, showing the basic structure of the invention when used in conjunction with an integral keyed cylinder lock. An outer casing 1 houses an inner lock casing 2, and a conventional keyed cylinder lock mechanism 3. Both the outer casing 1 and the inner lock casing 2 may be made of a variety of tamper-resistant materials (preferably metal) such that they may withstand physical abuse if an attempt is made to break the lock mechanism. The ganged co-axial tumbler lock mechanism contained within the inner lock casing 2 may be integrally installed within the outer casing 1 if appropriate fixtures exist within the outer casing 1 for attaching the lock mechanism.

In an alternative embodiment, the cylinder lock mechanism 3 is not integrally manufactured as part of the overall protection mechanism but is a pre-installed lock on an object such as a door. In this embodiment, the lock protection mechanism of the present invention may be bolted onto the door over the keyhole of an existing cylinder lock. Shown in FIG. 2 are bolt holes 10 that permit affixing the door lock protection mechanism to an existing door. External bolts or screws configured with a "security" head which can be screwed in but not out can be used, or inside bolts may be used.

Shown within the inner lock casing 2 are four ganged co-axial tumbler lock mechanisms 4. As described in greater detail below, these tumbler mechanisms 4 may be set by a user to any combination. When the proper combination is set on the tumbler mechanisms 4, a co-axial lock shaft 5 may be slideably actuated by a pivoting arm 6 coupled to the shaft by a first link 7. The other end of the shaft 5 is coupled by a second link 8 to a pivoting keyhole cover 9 which is preferably made out of a tamper-resistant material, such as metal. When the lock mechanism is set to its open combination, actuation of the pivot arm 6 (by means, for example, of a rotating knob 11 as shown in FIG. 1) causes the lock shaft 5 to pull on and thereby rotate the keyhole cover 9 such that both an opening in front of the keyhole cover 9 and the area behind the keyhole cover 9 are exposed. Situated behind the opening is the keyhole of the keyed cylinder lock mechanism 3. At this point, a user may insert a key into the keyhole of the cylinder lock mechanism 3 and unlock the door in conventional fashion.

When the user wishes to lock the door, the keyed lock mechanism 3 is locked in a conventional fashion. The user may then turn the pivoting arm 6 such that the keyhole cover 9 is pivoted into place and covers the keyhole of the cylinder lock mechanism 3. In an alternative embodiment, the shaft 5 may be spring biased such that release by the user of the pivot arm 6 will cause the keyhole cover 9 to be automatically repositioned so as to cover the keyhole of the cylinder lock mechanism 3. By rotating the tumbler mechanisms 4, the open combination is reset to a non-open combination. Doing so locks the shaft 5 into place such that further movement of the pivot arm 6 will not cause the shaft 5 to slideably move through the tumbler mechanisms 4.

Figure 3:
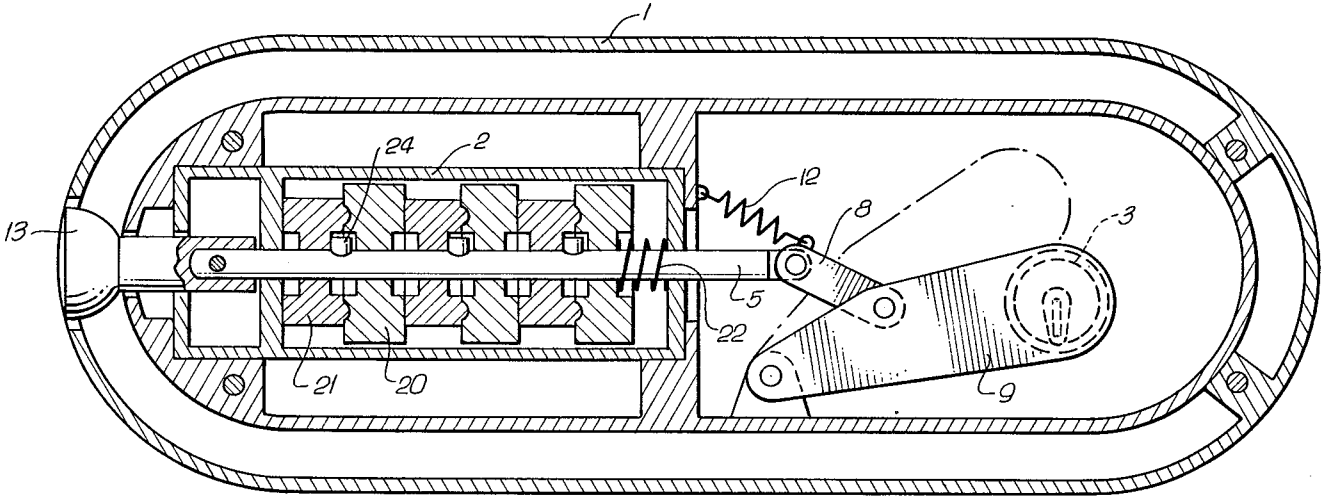
FIG. 3 is an exposed top view of a second embodiment of the present invention.

FIG. 3 shows an exposed top view of a second embodiment of the present invention, showing a differently shaped outer casing 1. The general lock mechanism is similar to the mechanism shown in FIG. 2, except that the pivoting arm 6 and first link 7 are not employed. Rather, the lock shaft 5 is biased by a spring 12 such that the lock shaft 5 will slide away from the cylinder lock mechanism 3, thereby pivoting the keyhole cover 9 such that the keyhole of the keyed lock mechanism 3 is exposed. A plunger end 13 of the lock shaft 5 will then project through a hole in the casing 1.

The keyhole cover 9 can be pivoted back into place, covering the keyhole of the cylinder lock mechanism 3, by pushing the plunger end 13 of the shaft 5 back into the casing 1. Rotating a tumbler wheel 20 will maintain the lock shaft 5 in its closed position.

Figure 4:
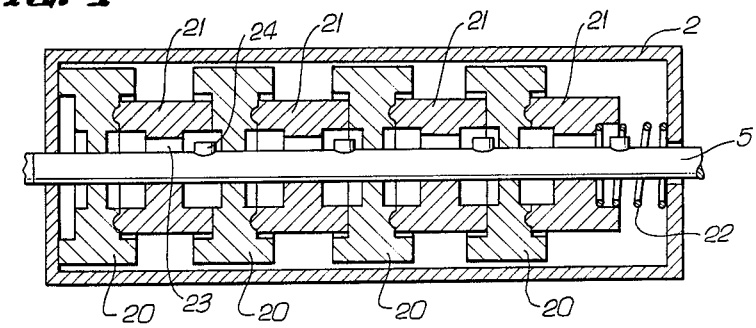
FIG. 4 is a cross-sectional view of the tumbler lock mechanism of the present invention.

FIG. 4 is a cross-sectional view of the inner lock casing 2 showing the structure of the lock mechanism. In the preferred embodiment, the lock mechanism comprises four tumbler wheels 20 and four corresponding lock wheels 21 all co-axially situated on the lock shaft 5. However, any number of pairs of lock wheels 21 and tumble wheels 20 can be used (as shown in FIG. 3, where only 3 pairs are used). If each tumbler wheel can be set at one of ten possible positions, then the lock mechanism shown in FIG. 2 and FIG. 4 has 10,000 potential combinations. More security may be obtained by adding a fifth pair of lock and tumbler wheels, thereby raising the number of possible combinations to 100,000.

A spring 22 is interposed between one side of the inner lock casing 2 and one of the wheels (either a lock wheel 21 or a tumbler wheel 20) so as to bias the lock and tumbler wheels in close juxtaposition. As can be seen from FIG. 4, the lock wheels 21 are smaller in diameter than the tumbler wheels 20. The tumbler wheels 20 bear numerals or other marks which are visible to the user through openings in the inner lock casing 2 and outer casing 1, as shown in FIG. 1. Under certain conditions, each lock wheel 21 may be rotated independently of its corresponding tumbler wheel 20. At other times, each tumbler wheel 20 and its corresponding lock wheel 21 are ganged together so that rotation of a tumbler wheel causes the corresponding lock wheel to also move the same rotational amount.

Figure 5:
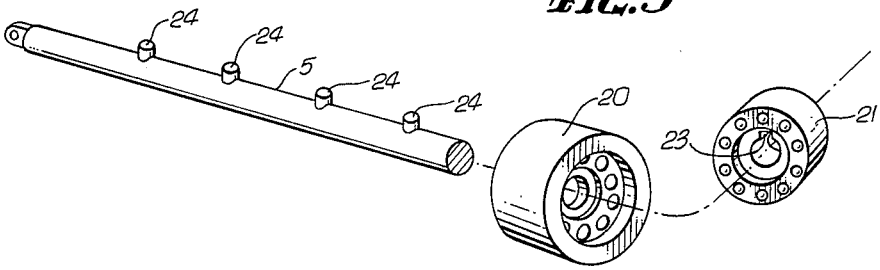
FIG. 5 is a perspective view of a lock wheel, a tumbler wheel, and the locking bar of the present invention.

FIG. 5 shows a close-up cross-sectional view and front view of a lock wheel 21 and a tumbler wheel 20. Each lock wheel 21 includes a lock slot 23. Each paired lock wheel 21 and tumbler wheel 20 contain corresponding friction or detention surfaces such that the two wheels do not freely rotate against each other, but can be rotated with respect to one another if sufficient force is applied after the lock is set to its open combination.

Each locking wheel 21 is configured to be positioned co-axially with an associated tumbler wheel 20 as shown in FIG. 4. The lock shaft 5 is positioned as an axle for each pair of lock and tumbler wheels. The lock shaft 5 has at least one small key projection 24 for each pair of locking and tumbler wheels. Each lock wheel 21 and tumbler wheel 20 has a counter-sunk portion, as shown in FIG. 5. A pair of wheels thus forms an annular space in which a key projection 24 of the shaft 5 may project without interference with the wheels when they are rotated. In FIG. 4, the key projections 24 of the shaft 5 are not blocked from movement by the locking wheels 21. Therefore, rotation by a user of a tumbler wheel 20 will cause (by means of detention projections or friction) its associated lock wheel 21 to also rotate freely around the shaft 5. The key projections 24 of the shaft 5 prevent the shaft from being slideably disposed in either direction unless the key slot 23 of each lock wheel 21 is rotated into alignment with the key projections 24 of the shaft 5. When such alignment occurs, the shaft 5 may be slid from one side to the other of the inner lock casing 2.

A user may change the combination of the locking mechanism by first setting the tumbler wheels 21 to the proper open combination such that the key slot 23 of each locking wheel 20 is aligned with its corresponding key projection 24 on the shaft 5. The shaft 5 may then be slid such that each key projection 24 is situated within a key slot 23 of each locking wheel 21. At this point, the user may then rotate the tumbler wheels 20 to change the combination. That is, since the locking wheels 20 are no longer free to move (being blocked by the key projections 24 of the shaft 5), and each tumbler wheel 20 is only frictionally coupled to its corresponding locking wheel 21, by supplying sufficient force the user may rotate the tumbler wheels to a new position. Upon sliding the shaft so that the key projections 24 are no longer disposed within the key slots 23, the tumbler wheels 20 are then again frictionally ganged with their corresponding lock wheels 21, but a new combination is now set on the locking mechanism.

In some embodiments, it may be desirable to include a ratchet mechanism such that the tumbler wheels 20 may be turned in one direction only. Such a feature improves the security of the lock mechanism since it requires more time for a would-be burglar to attempt to set possible combinations on the lock mechanism in order to open the lock mechanism.

Again referring to FIG. 2, the locking shaft 5 is coupled to the pivot arm 6 by a first link 7 and to the key hole cover 9 by a second link 8. When the proper combination is set on the tumbler wheels 4, rotation by the user of the pivot arm 6 causes the keyhole cover 9 to rotate such that the keyhole mechanism of the cylinder lock 3 is exposed.

As an alternative to the pivot arm 6, keyhole cover 9, and their associated links 7, 8, the shaft 5 may be coupled to a simple handle on one end and a plate or projection acting as a keyhole cover on the other end. When the proper combination is set on the tumbler mechanisms 4, the shaft and attached keyhole cover may be simply slid away so as to expose the keyhole of the associated cylinder lock. (FIG. 3 represents a combination of this configuration with a pivoting keyhole cover 9).

In any of the embodiments of the present invention, the outer casing 1 may be designed to accommodate a battery and lamp in the space adjacent to the inner lock casing 2. The purpose of the lamp is to illuminate the numbers or figures of the tumbler mechanism 4 for ease of use in darkness, and optionally to illuminate the exposed keyhole once the keyhole cover 9 is moved into its opened position. A variety of switching mechanisms may be used to activate the lamp, including a push-button switch, an electric eye that automatically activates the lamp in darkness, or a touch sensitive switch which activates the lamp when the lock mechanism is touched by the user.

While this invention had been described with reference to a preferred embodiment, it is not intended that this description be construed in a limiting sense. Various modifications of the preferred embodiment as well as other embodiments of the invention, will be apparent to persons skilled in the art upon reference to this description. For example, while the embodiments shown are illustrated in the context of a door lock, the inventive concept can be adapted to locks on other objects. Moreover, generally the materials used in making the inventive lock mechanism are not critical, but ideally should be strong, durable, and tamper-resistant. It is therefore contemplated that the appended claims will cover any modifications or embodiments as fall within the true scope of the invention.

I claim:

1. A keyhole protected lock comprising:

(a) a housing adapted to be secured to an object to be securely locked, the housing having an integral keyed cylinder primary lock for locking the object and having an opening allowing access to the keyhole of the keyed cylinder lock;

(b) a secondary co-axial tumbler lock mechanism located in the housing and having a co-axial shaft slidably movable between a first secure position when the tumbler lock mechanism is set to a locked position, and a second position when the tumbler lock mechanism combination is set to an unlocked position;

(c) means for slidably moving the shaft from its first position to its second position when the tumbler lock mechanism is unlocked;

(d) a keyhole cover movably located in the housing and coupled to the shaft, the keyhole cover being movable between (1) a closed position covering the keyhole of the keyed cylinder lock when the shaft is in its first position, preventing access to the keyhole, and (2) an open position uncovering the keyhole when the shaft is moved to its second position, allowing access to the keyhole;

wherein the keyhole cover is pivotally mounted in the housing, and the shaft is coupled to the keyhole cover by means of a linkage pivotally coupled at one end to the shaft, and pivotally coupled at the other end to the keyhole cover, such that the keyhole cover can be rotated between its closed position and its open position when the shaft is slid between its first position and its second position.

2. A keyhole cover lock comprising:

(a) a housing adapted to be secured to an object in which a keyed cylinder lock is located, the housing having an opening allowing access to the keyhole of the keyed cylinder lock;

(b) a co-axial tumbler lock mechanism located in the housing and having a co-axial shaft slidably movable between a first secure position when the tumbler lock mechanism is set to a locked position, and a second position when the tumbler lock mechanism combination is set to an unlocked position;

(c) means for slidably moving the shaft from its first position to its second position when the tumbler lock mechanism is unlocked;

(d) a keyhole cover movably located in the housing and coupled to the shaft, the keyhole cover being movable between (1) a closed position covering the keyhole when the shaft is in its first position, preventing access to the keyhole, and (2) an open position uncovering the keyhole when the shaft is moved to its second position, allowing access to the keyhole;

wherein the keyhole cover is pivotally mounted in the housing, and the shaft is coupled to the keyhole cover by means of a linkage pivotally coupled at one end to the shaft, and pivotally coupled at the other end to the keyhole cover, such that the keyhole cover can be rotated between its closed position and its open position when the shaft is slid between its first position and its second position.

3. A keyhole protected lock comprising:

(a) a housing adapted to be secured to an object to be securely locked, the housing having an integral keyed cylinder primary lock for locking the object and having an opening allowing access to the keyhole of the keyed cylinder lock;

(b) a secondary co-axial tumbler lock mechanism located in the housing and having a co-axial shaft slidably movable between a first secure position when the tumbler lock mechanism is set to a locked position, and a second position when the tumbler lock mechanism combination is set to an unlocked position;

(c) means for slidably moving the shaft from its first position to its second position when the tumbler lock mechanism is unlocked;

(d) a keyhole cover movably located in the housing and coupled to the shaft, the keyhole cover being movable between (1) a closed position covering the keyhole of the keyed cylinder lock when the shaft is in its first position, preventing access to the keyhole, and (2) an open position uncovering the keyhole when the shaft is moved to its second position, allowing access to the keyhole; and (e) a bias spring coupled to the housing and the shaft, wherein the shaft is spring biased so as to automatically move from its first, secure position to its second position when the tumbler lock mechanism is set to an unlocked position.

4. A keyhole cover lock comprising:

(a) a housing adapted to be secured to an object in which a keyed cylinder lock is located, the housing having an opening allowing access to the keyhole of the keyed cylinder lock;

(b) a co-axial tumbler lock mechanism located in the housing and having a co-axial shaft slidably movable between a first secure position when the tumbler lock mechanism is set to a locked position, and a second position when the tumbler lock mechanism combination is set to an unlocked position;

(c) means for slidably moving the shaft from its first position to its second position when the tumbler lock mechanism is unlocked;

(d) a keyhole cover movably located in the housing and coupled to the shaft, the keyhole cover being movable between (1) a closed position covering the keyhole when the shaft is in its first position, preventing access to the keyhole, and (2) an open position uncovering the keyhole when the shaft is moved to its second position, allowing access to the keyhole; and (e) a bias spring coupled to the housing and the shaft, wherein the shaft is spring biased so as to automatically move from its first, secure position to its second position when the tumbler lock mechanism is set to an unlocked position.

5. The lock of claim 1, 2, 3 or 4, wherein the combination of the tumbler lock mechanism is resettable when the tumbler lock mechanism is set to an unlocked position.

6. The lock of claim 1, 2, 3 or 4, further including a ratchet mechanism in contact with the tumbler lock mechanism such that the combination wheels of the tumbler lock mechanism can be rotated only in one direction.

7. The lock of claim 1, 2, 3 or 4, further including a light means mounted within the housing for illuminating the combination wheels of the tumbler lock mechanism.

8. The lock of claim 1, 2, 3 or 4, further including a light means mounted within the housing for illuminating the exposed keyhole when the keyhole cover is moved into its open position.

* * * * *